US007189117B2

(12) United States Patent
Kawamura et al.

(10) Patent No.: US 7,189,117 B2
(45) Date of Patent: Mar. 13, 2007

(54) SHIELDED CONNECTOR AND METHOD OF CONNECTING IT WITH A SHIELDED CABLE

(75) Inventors: Masayuki Kawamura, Yokkaichi (JP); Masato Minakata, Toyota (JP); Atsushi Nishida, Toyota (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/483,749

(22) Filed: Jul. 10, 2006

(65) Prior Publication Data

US 2007/0021006 A1 Jan. 25, 2007

(30) Foreign Application Priority Data

Jul. 13, 2005 (JP) ..... 2005-204243

(51) Int. Cl.
*H01R 13/648* (2006.01)

(52) U.S. Cl. ..... 439/610; 439/607

(58) Field of Classification Search ..... 439/607–610, 439/595, 598, 352–358, 578–585, 98, 701; 174/359

See application file for complete search history.

(56) References Cited

U.S. PATENT DOCUMENTS 4,634,208 A * 1/1987 Hall et al. ..... 439/610
4,854,895 A * 8/1989 Komatsu ..... 439/610
4,985,002 A * 1/1991 Maisch et al. ..... 439/607
6,113,429 A * 9/2000 Weigel et al. ..... 439/610
7,064,266 B2 * 6/2006 Wada ..... 174/359
7,101,223 B2 * 9/2006 Neumann et al. ..... 439/585

FOREIGN PATENT DOCUMENTS

JP 7-263082 10/1995

* cited by examiner

*Primary Examiner*—Truc T. Nguyen
*Assistant Examiner*—Edwin A. Leon
(74) *Attorney, Agent, or Firm*—Gerald E. Hespos; Anthony J. Casella

(57) ABSTRACT

A shielding shell (18) is integrated into a housing (5) by insert molding, whereas a shell connecting member (22) is mounted on an end of a braided wire (2) of a shielded cable (1) by crimping a crimping ring (23) and can be brought into contact with the inner surface of the shielding shell (18). A cover (17) is mounted on the rear end of the housing (5) to retain the shell connecting member (22). As the crimping ring (23) is crimped, ribs (26) are formed to project and each of them is engageable with any one of turn preventing recesses (35) arranged at a plurality of positions along circumferential direction on the inner circumferential surface of the cover (17). Thus, the shell connecting member (22) is prevented from turning, thereby causing no abrasion at contact portions with the shielding shell (18).

10 Claims, 9 Drawing Sheets

SHIELDED CONNECTOR AND METHOD OF CONNECTING IT WITH A SHIELDED CABLE

BACKGROUND OF THE INVENTION

1. Field of the Invention

The invention relates to a shielded connector and to a method of connecting or assembling it with a shielded cable.

2. Description of the Related Art

Japanese Unexamined Patent Publication No. H07-263082 discloses a shielded connector for use with a shielded cable that has wires covered by a braided wire. Terminal fittings are connected with ends of the wires and are mounted in a synthetic resin housing of the connector. A metallic shielding shell is provided in the housing and has springy contacts that touch the braided wire. Plating on the contacts may abrade, for example, if the cable is twisted, and the peeling of the plating may increase electrical resistance.

The invention was developed in view of the above problem, and an object thereof is to provide a shielded connector and a connecting method therefor capable of securing a stable connected state with a shielding shell.

SUMMARY OF THE INVENTION

The invention relates to a shielded connector to be connected with a shielded cable. The cable is formed by covering one or more wires with a shielding conductor. The shielded connector has a housing for accommodating terminal fittings that are connected with ends of the wires. A shielding shell is provided in or on the housing and surrounds the terminal fittings. Tubular connecting means are mounted on an end of the shielding conductor for contacting the shielding shell. A cover is mounted to the housing to retain the connecting means, and locking means are provided between the cover and the connecting means for preventing the connecting means from twisting about an axis thereof. Accordingly, the shielding shell will not abrade even if the shielded cable twists about its central axis.

The shielding shell may be insert molded in the housing.

The locking means preferably includes at least one projection that projects substantially radially from one of the cover and the connecting means and at least one recess formed in the other for receiving the projection.

The projection and the recess preferably are arranged at plural circumferentially spaced positions and are selectively engageable with the mating portion. Accordingly, the engagement of the projection and the recess prevent the turn of the connecting means. It is sufficient to select one of the projections or the recesses. Thus, an operation of positioning the projection and the recess in the circumferential direction for locking is simplified.

The connecting means preferably includes a shell connecting member that fits to an end of the shielding conductor for contacting the shielding shell.

The connecting means preferably includes a crimping ring on the end of the shielding conductor and crimped while squeezing the shielding conductor between the crimping ring and the shell connecting member. Thus, the crimping ring is fixed to the shielding conductor and united with the shell connecting member.

The projection preferably is a collar extending longitudinally and formed upon crimping the crimping ring. Accordingly, it is not necessary to set a special turn preventing structure, wherefore the construction can be simplified and the production process can be performed efficiently.

The invention also relates to a method of assembling a shielded connector. The method comprises connecting terminal fittings with ends of wires of a shielded cable. The method further includes providing a housing for accommodating the terminal fittings and having a shielding shell in or on the housing for substantially surrounding the terminal fittings. The method then includes mounting tubular connecting means on an end of the shielding conductor for contacting the shielding shell, fixing a cover to the housing to retain the connecting means, and providing locking means between the cover and the connecting means for preventing the turn of the connecting means.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTON OF THE PREFERRED EMBODIMENTS

Figure 1:
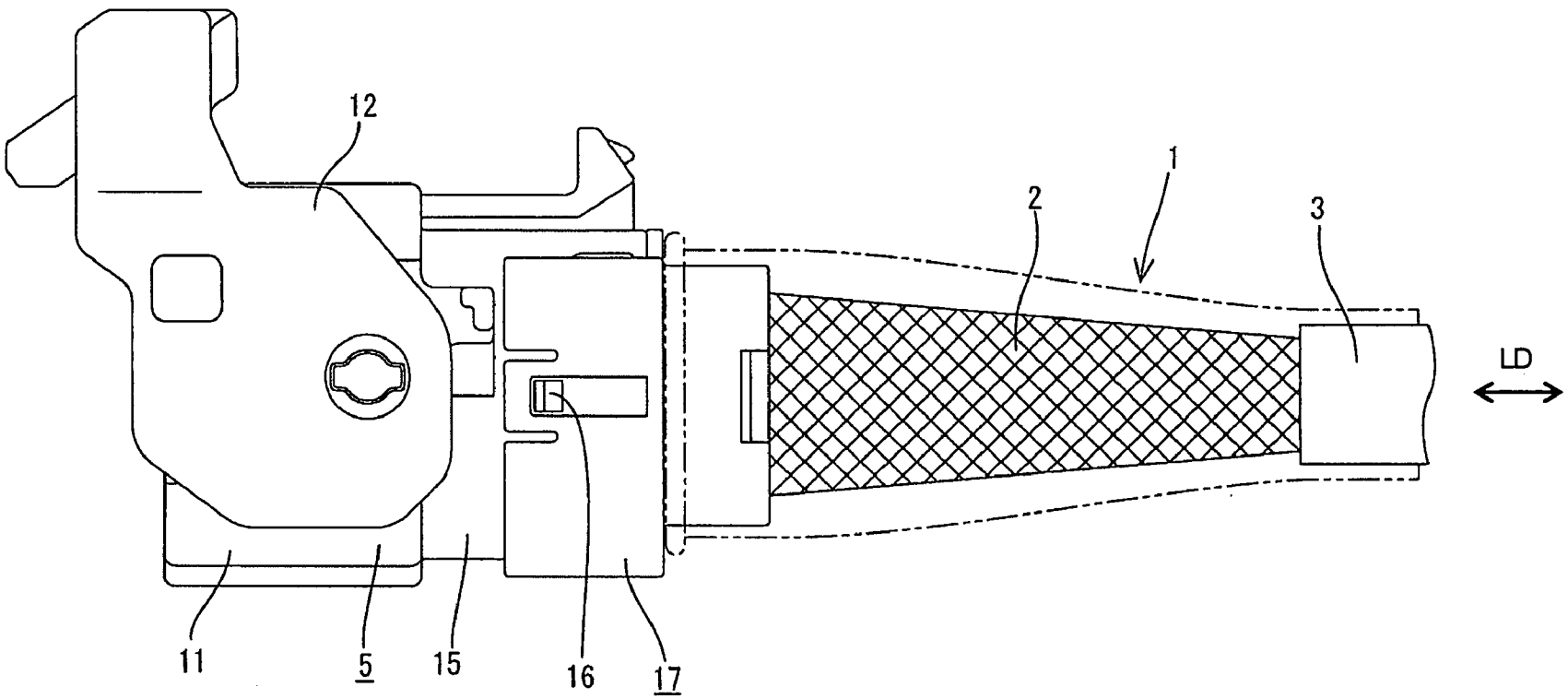
FIG. 1 is a side view of a shielded connector.
Figure 2:
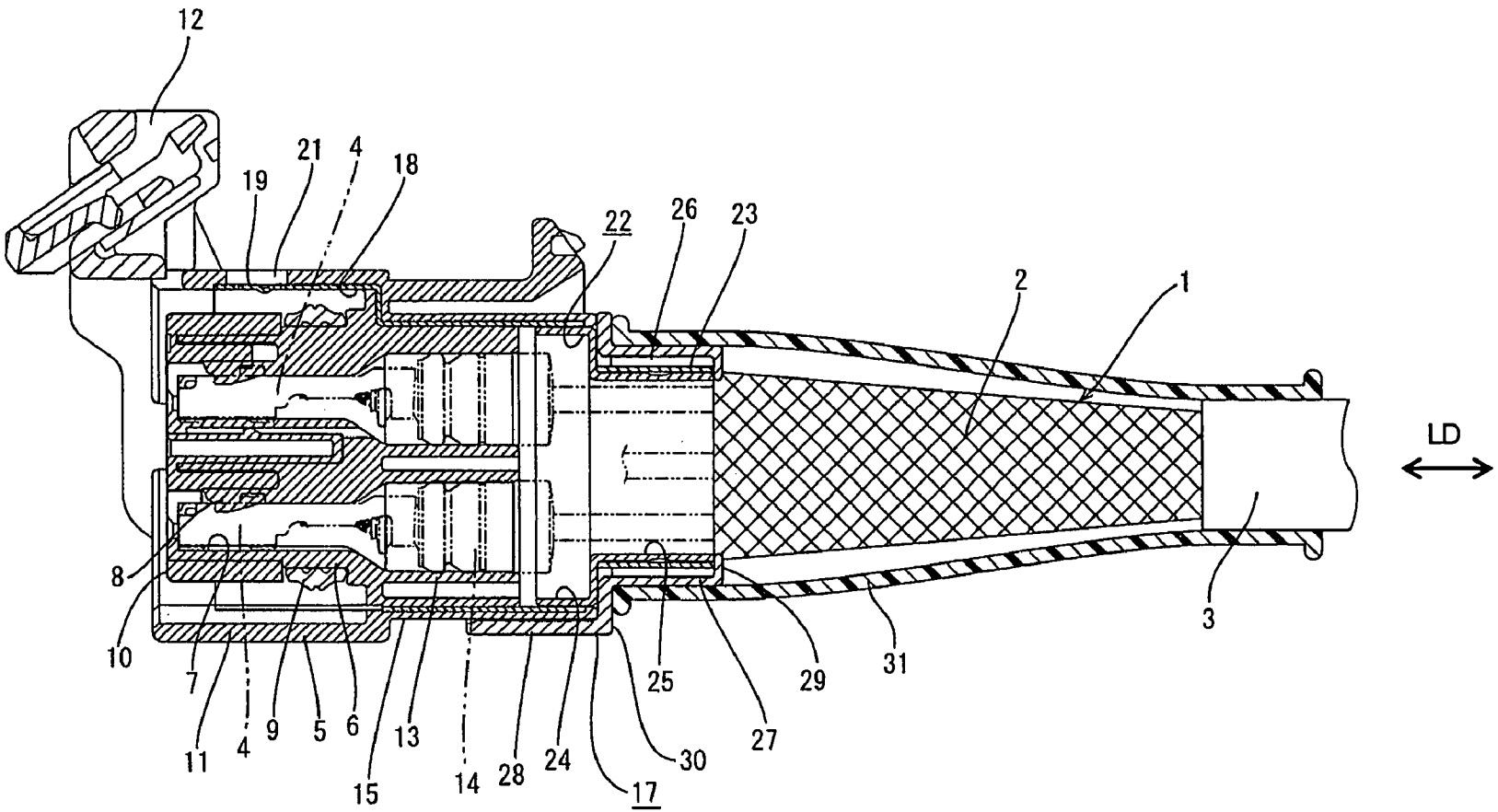
FIG. 2 is a side view in section of the shielding conductor.
Figure 3:
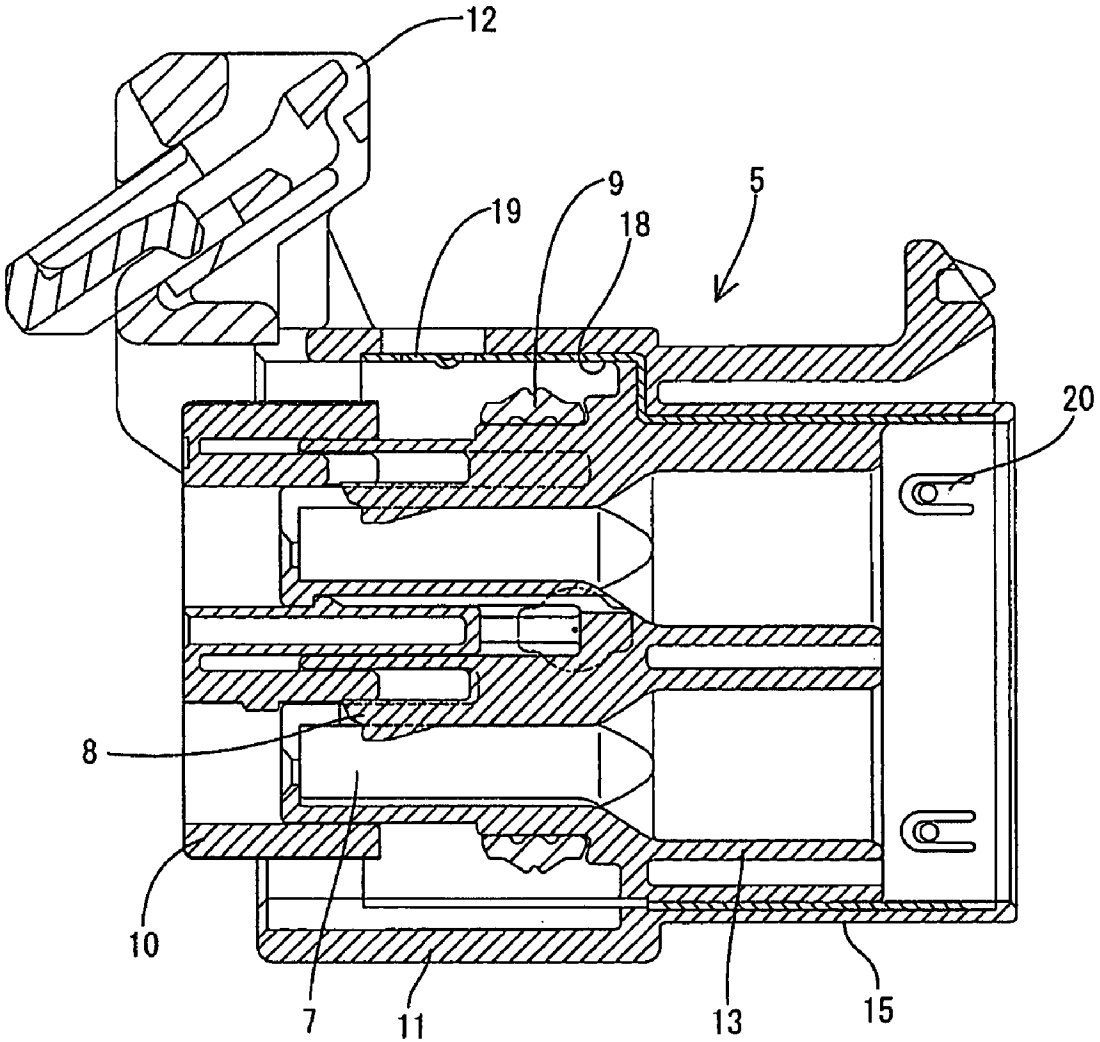
FIG. 3 is a side view in section of a connector housing.
Figure 4:
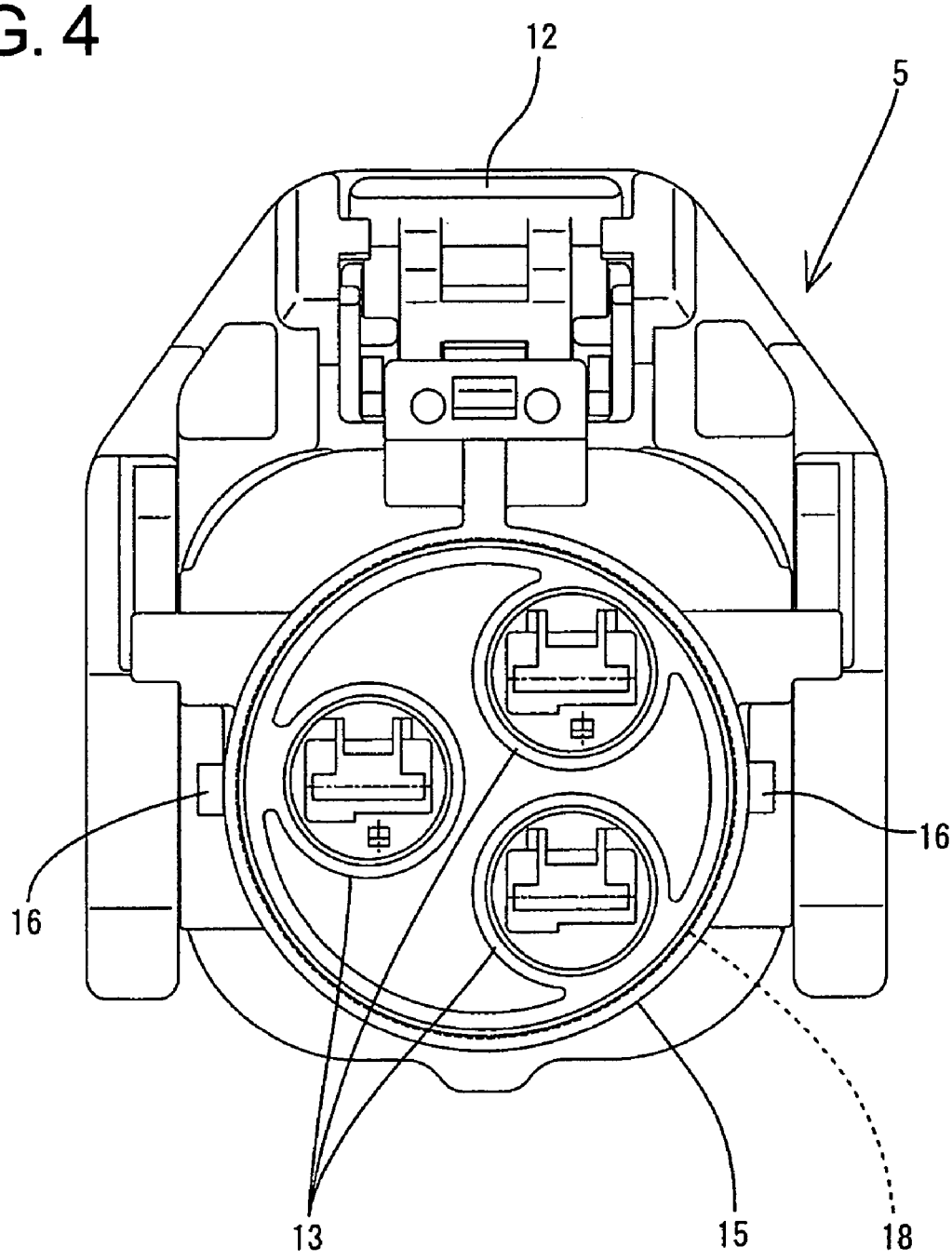
FIG. 4 is a rear view of the connector housing.
Figure 5:
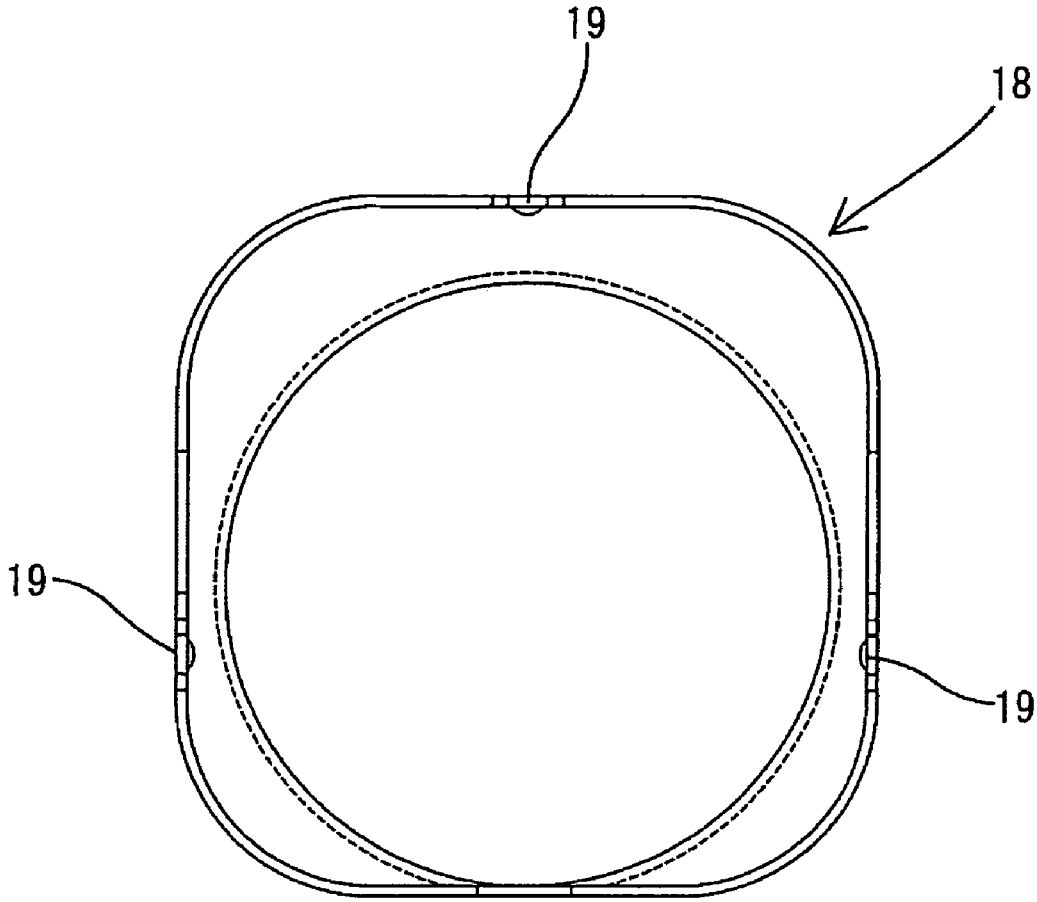
FIG. 5 is a front view of a shielding shell.

The connector of the invention is used with a shielded cable identified by the numeral 1 in the figures. The entire shielded cable 1 is formed so that wires are wrapped together by a tubular braided wire 2. A sheath 3 is mounted around the braided wire 2. Each wire has a multitude of stranded conductors enfolded in an insulating coating. In the following description, a mating end with an (unillustrated) mating connector (e.g. left side in FIGS. 1 to 3) is referred to as the front.

A terminal fitting 4 is connectable with an end of each wire and is accommodated in a housing 5 of the shielded connector. The housing 5 is made e.g. of a synthetic resin and a rectangular tubular terminal accommodating portion 6 is formed at a front portion of the housing 5. Cavities 7 penetrate the terminal accommodating portion 6 in forward and backward directions and a resiliently deformable lock 8 is formed in each cavity 7 for engaging the terminal fitting 4. A sealing ring 9 is mounted at the back side of the outer peripheral surface of the terminal accommodating portion 6 to provide sealing between the shielded connector and a mating connector. A cap-shaped retainer 10 is mountable on the front end of the terminal accommodating portion 6. Parts of the retainer 10 enter deformation spaces for the locks 8 to prevent deformation of the locks 8 and to retain the terminal fittings 4 more securely. The rear of the retainer 10 opposes the front of the sealing ring 9 to prevent the sealing ring 9 from coming out upon separating the two connectors.

A receptacle 11 is formed outside the terminal accommodating portion 6 and defines a connection space for receiving the mating connector. A substantially U-shaped lever 12 is mounted rotatably on the outer surfaces of the receptacle 11. Rotation of the lever 12 generates a cam action to assist a connecting operation with the mating connector.

Sealing towers 13 extend from the rear end of the terminal accommodating portion 6. The sealing towers 13 are substantially hollow cylinders that communicate coaxially with the respective cavities 7. A seal 14 is mounted on each wire and is accommodated in the respective sealing tower 13. A substantially cylindrical fitting tube 15 is formed at the rear end of the terminal accommodating portion 6. The fitting tube 15 surrounds and unitarily couples the sealing towers 13. The rear end edge of the fitting tube 15 projects back beyond the rear ends of the sealing towers 13. Locking projections 16 project at transversely symmetric positions on the outer surface of the fitting tube 15 to mount a cover 17 on the fitting tube 15 as explained herein.

A conductive metallic shielding shell 18 is embedded in the housing 5 by insert molding. A front portion of the shielding shell 18 is a substantially rectangular tube, and a rear portion has a substantially cylindrical shape. The front portion of the shielding shell 18 is exposed along the inner surface of the receptacle 11. Resilient contacts 19 are arranged on the shielding shell 18 and are resiliently deformable in and out. The resilient contacts 19 contact a ground (not shown) in the mating connector when the connectors are connected. The rear of the shielding shell 18 is embedded in the sealing towers 13, but is exposed along the inner surface of the fitting tube 15. Similar resilient contacts 20 are arranged on the exposed part of the rear half of the shielding shell 18. The housing 5 has escaping holes 21 for exposing the resilient contacts 19, 20 to the outside. Thus, the resilient contacts 19, 20 can deform outward.

A connecting means is provided for connecting the braided wire 2 and the shielding shell 18. The connecting means comprises a shell connector 22 and a crimping ring 23 that are mountable on the shielded cable 1.

Figure 6:
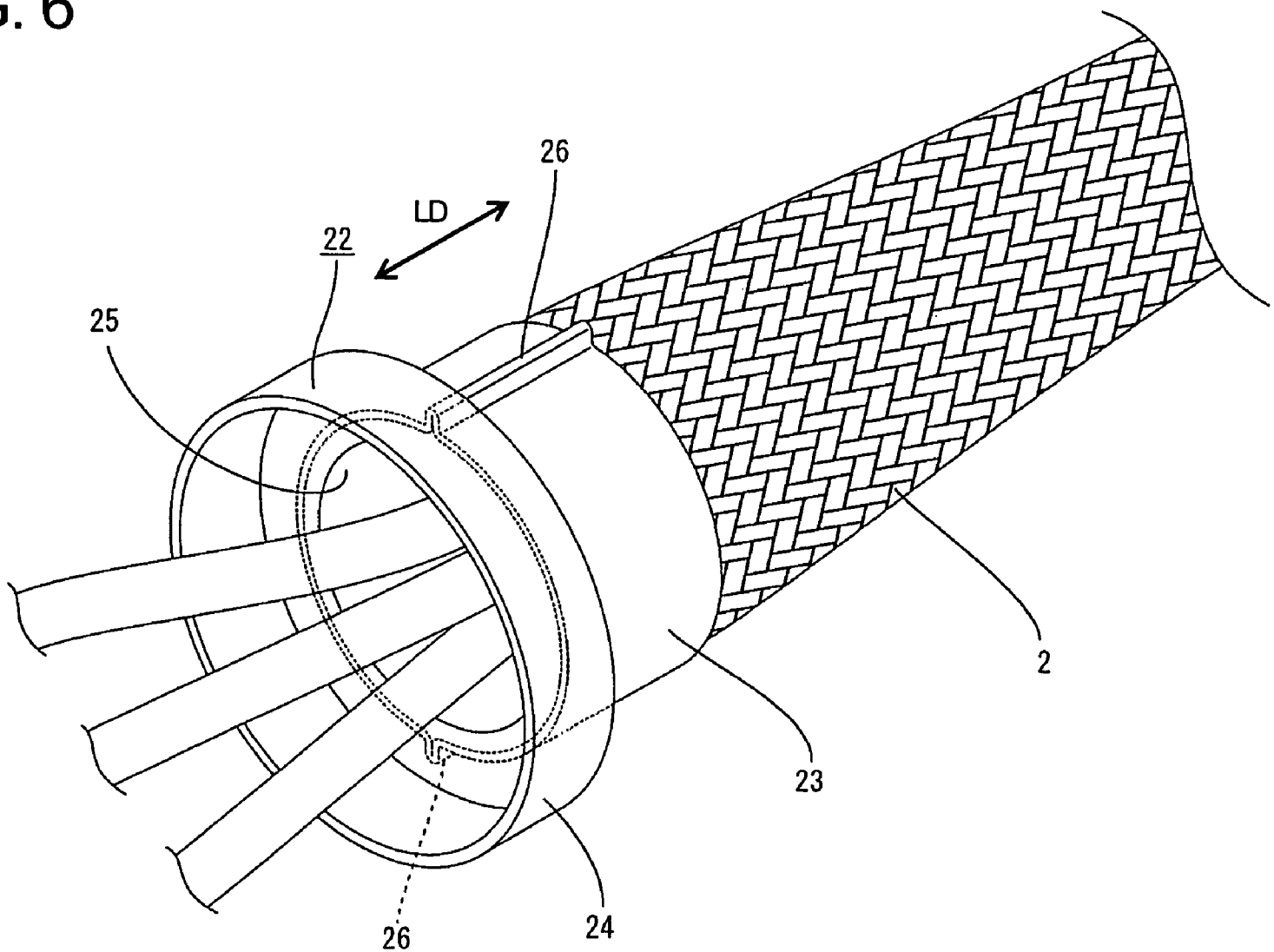
FIG. 6 is a perspective view showing an end of a shielded cable.
Figure 7:
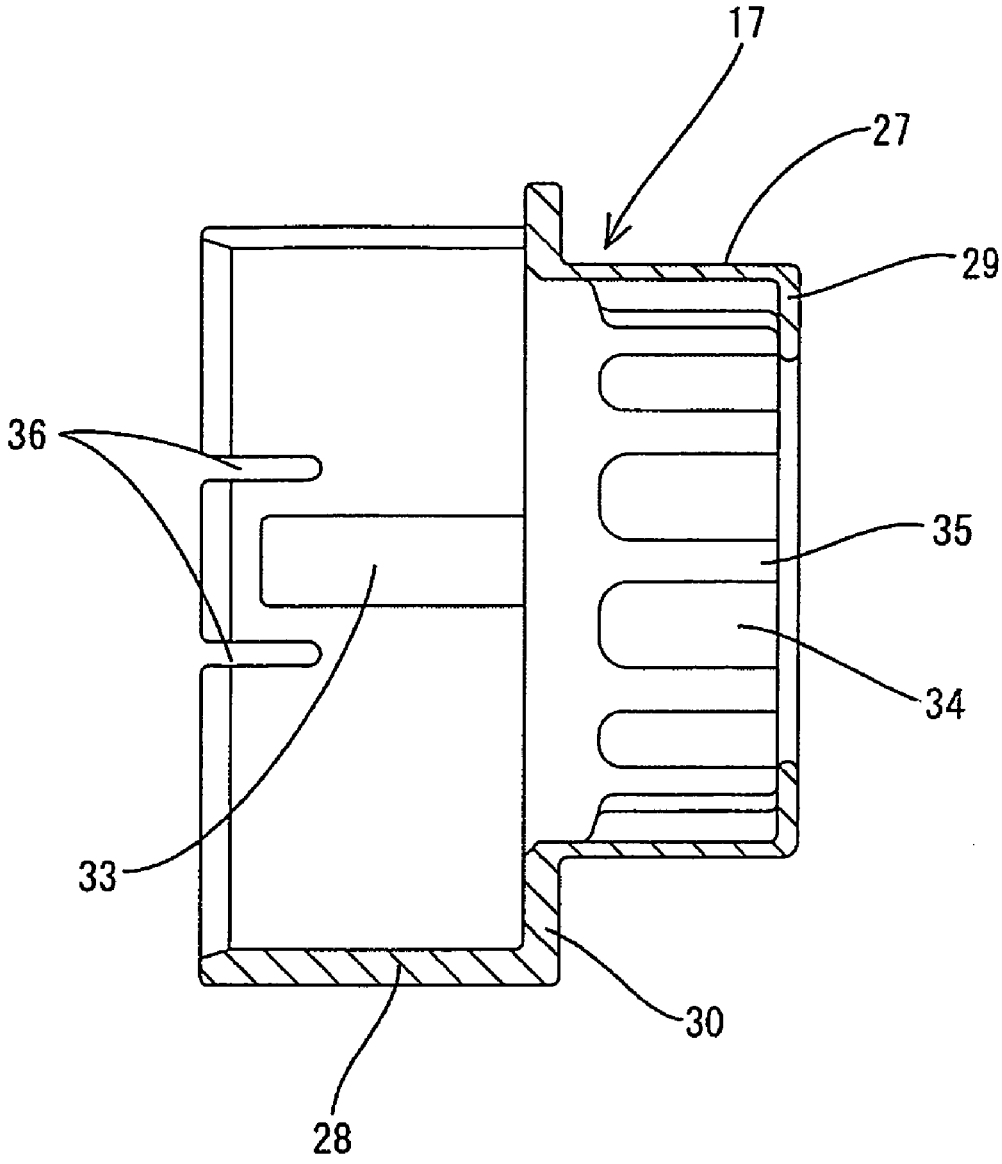
FIG. 7 is a side view in section of a cover.
Figure 8:
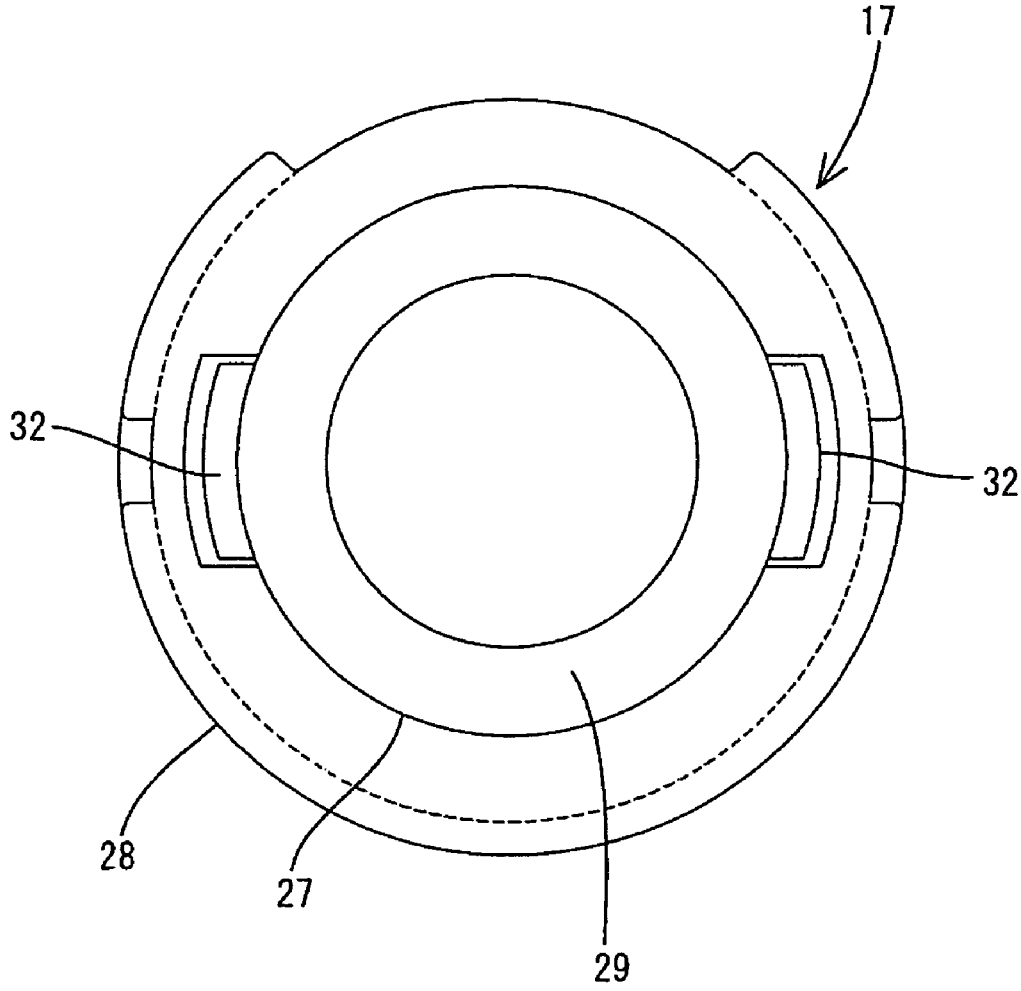
FIG. 8 is a rear view of the cover.
Figure 9:
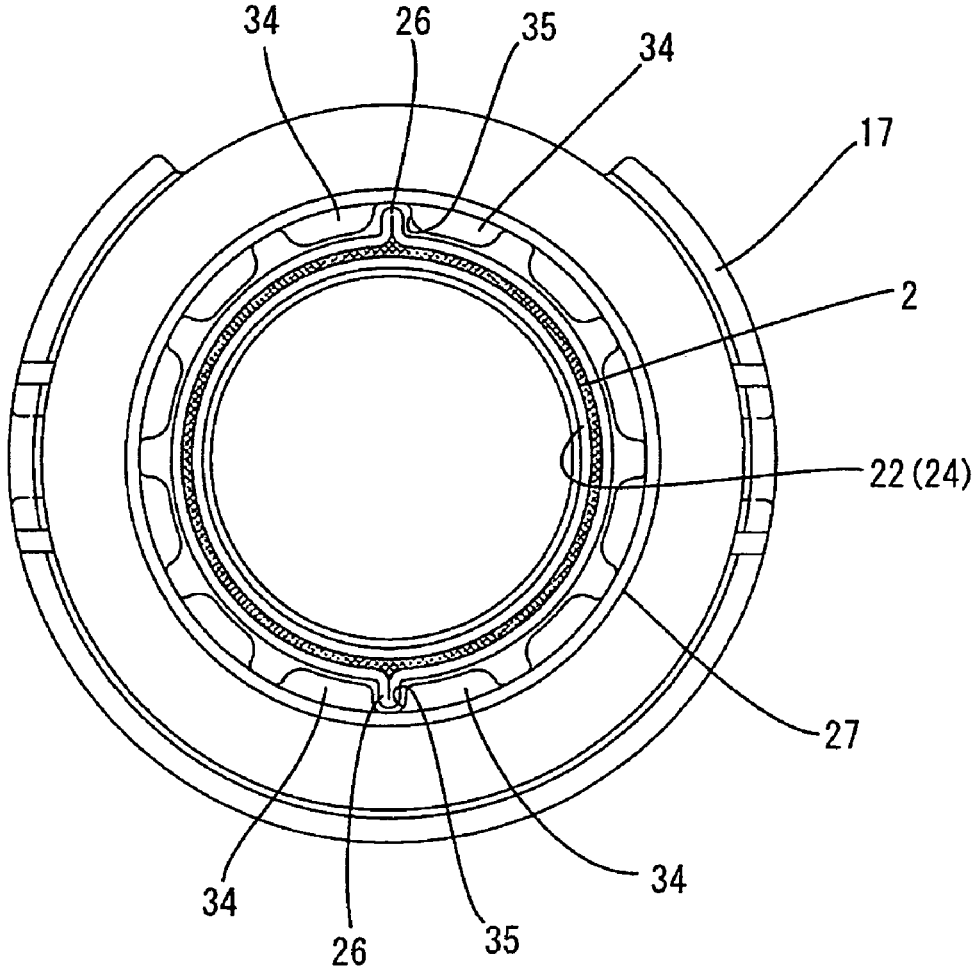
FIG. 9 is a front view in section showing an engaged state of turn preventing recesses and ribs.

The shell connector 22 is made of an electrically conductive material, such as metal, and has a stepped substantially cylindrical shape with a large-diameter portion 24 at the front and a small-diameter portion 25 at the rear, as shown e.g. in FIG. 6. The large-diameter portion 24 is fittable into the fitting tube 15 to be connected with the rear end of the shielding shell 18. The small-diameter portion 25 is fit in the braided wire 2 from an end of the braided wire 2. The crimping ring 23 then is crimped from the outside for mounting the shell connector 22 on the end of the braided wire 2. Material at the outer circumferential surface of the crimping ring 23 is gathered at the opposite sides as the crimping ring 23 is crimped and forms two ribs 26. The ribs 26 project radially out at substantially symmetric positions on the crimping ring 23, as shown in FIG. 6, and extend substantially the entire length along longitudinal direction LD.

The synthetic resin cover 17 is mounted to the rear end of the fitting tube 15 for retaining the shell connector 22. A substantially cylindrical surrounding portion 27 is formed at the rear half of the cover 17. A jaw edge 29 bulges in along substantially the entire circumference near the rear end of the cylindrical surrounding portion 27. On the other hand, a substantially concentric flange 30 bulges out near the front end of the cylindrical surrounding portion 27 for contacting the rear edge of the crimping ring 23.

An arcuate surrounding portion 28 extends forward from an area of the outer peripheral edge of the flange 30 except an upper side and has an arcuate shape substantially concentric with the cylindrical surrounding portion 27. Left and right catching projections 32 project from the outer circumferential surface of the cylindrical surrounding portion 27 to retain a resilient rubber boot 31 on the cover 17. The arcuate surrounding portion 28 is fittable on the fitting tube 15 of the housing 5, and has two locking holes 33 disposed respectively at the opposite left and right sides. Slits 36 are formed near the locking holes 32 and extend from the opening edge of the arcuate surrounding portion 28 at the opposite sides of the locking hole 33. Areas around the slits 36 including the locking holes 33 make it easier for the arcuate surrounding portion 28 to move over the locking projections 16.

Elongated projections 34 are spaced circumferentially at substantially equal intervals on the inner surface of the cylindrical surrounding portion 27 and extend substantially parallel to longitudinal direction LD. Turn preventing recesses 35 are defined between the adjacent elongated projections 34 and receive the back sides of the ribs 26 of the crimping ring 23 to prevent the crimping ring 23 and the shell connecting member 22 from turning.

The shielded cable 1 is connected with the connector by removing the sheath 3 at an end of the shielded cable 1 to expose the braided wire 2 over a specified length. The braided wire 2 then is removed by a specified length shorter than the exposed length to expose front end portions of the wires. The cover 17 and the crimping ring 23 then are mounted successively from front on the outer circumferential surface of the braided wire 2 and are kept on standby at rear positions. The wires then are passed together through the shell connecting member 22, and the small-diameter portion 25 is slipped under the braided wire 2. The crimping ring 23 then is slid forward to squeeze the front end of the braided wire 2 between the small-diameter portion 25. The crimping ring 23 then is crimped in this state to narrow the diameter of the crimping ring 23. However, material at the outer circumferential surface of the crimping ring 23 is gathered together and bulges out as the crimping ring 23 is crimped to form a pair of ribs 26. Thus, the shell connecting member 22 is mounted on the front end of the braided wire 2 while being united with the crimping ring 23. The braided wire 2 then is retracted back to shrink in the longitudinal direction LD, and the terminal fittings 4 are connected with the front ends of the respective wires.

The terminal fittings 4 are inserted into the corresponding cavities 7 in the terminal accommodating portion 6 and doubly locked by the locks 8 and the retainer 10. The shell connecting member 22 then is moved forward to fit the larger-diameter portion 24 into the fitting tube 15 of the housing 5. In this way, the resilient contacts 20 in the rear of the shielding shell 18 resiliently touch the outer circumferential surface of the large-diameter portion 24. As a result the braided wire 2 and the shielding shell 18 are connected electrically.

The cover 17 then is moved forward so that the ribs 26 of the crimping ring 23 fit in the turn preventing recesses 35 of the cover 17. The cover 17 then is fit on the fitting tube 15 of the housing 5 so that the locking projections 16 engage the front edges of the locking holes 33. In this way, the cover 17 is fixed to the housing 5 and the flange 30 of the cover 17 contacts the rear end of the large-diameter portion 24 of the shell connecting member 22 to prevent backward displacement of the shell connecting member 22.

A front end portion of the rubber boot 31 fit on the shielded cable 1 beforehand is mounted on the cylindrical surrounding portion 27 of the cover 17. At this time, the inner circumferential surface of the front end of the rubber boot 31 is caught by the catching projections 32 to retain the resilient boot 31. As a result, the part of the braided wire 2 exposed by removing the sheath 3 is covered by the rubber boot 31, and tape (not shown) may be applied over a range extending to the sheath 3 at the rear end of the boot 31 fit on the front end of the sheath 3. Thus, the rubber boot 31 and the shielded cable 1 are united and water cannot enter through the rear end of the rubber boot 31.

The shielded cable 1 may be twisted about its longitudinal axis after the shielded connector is assembled, and may exert a torque on the shell connecting member 22. However, the ribs 26 engage the turn preventing recesses 35 to unite the crimping ring 23 with the shell connecting member 22 and to prevent the crimping ring 23 and the shell connecting member 22 from turning. Accordingly, angular displacement of the shell connecting member 22 relative to the shielding shell 18 is restricted, and there is no likelihood of abrading the resilient contact pieces 20 of the shielding shell 18. Thus, plating is not peeled at the contacts and a stable connection is achieved. Further, the turn preventing recesses 35 are arranged over substantially the entire circumference of the cover 17, and almost no time and labor are required for positioning upon uniting the cover 17 and the crimping ring 23. The ribs 26 that prevent the turn of the crimping ring 23 are formed as the crimping rib 23 is crimped. Thus, no special structure is needed for preventing the turn of the crimping ring 23, and the construction and production process are simplified.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The wires are shielded by the braided wire 2 in the foregoing embodiment. However, they may be wrapped by a metal leaf or conductive foil or conductive layer or any other applicable shielding.

The cover 17 is provided with recesses and the crimping ring 23 is provided with the ribs 26 to prevent the turn of the connecting means in the foregoing embodiment. However, the cover 17 may be provided with projections and the crimping ring 23 may be provided with recesses.

The shell connecting member 22 and the crimping ring 23 connect the braided wire 2 and the shielding shell 18 by crimping is. However, the connection with the braided wire 2 could be made by welding, soldering, clamping or the like and a single member is required as the connecting means in such a case.

The retainer doubly locks the terminal fittings by being inserted in the deformation spaces of the locks. However, the terminal fittings may simply be locked by the locks or by the retainer, and the retainer may be of the front-type or the side-type depending on the needs.

What is claimed is:

1. A shielded connector to be connected with a shielded cable having wires surrounded by a shielding conductor, the shielded connector comprising:

a housing for accommodating terminal fittings connected with ends of the respective wires;

a shielding shell mounted to the housing and substantially surrounding the terminal fittings;

tubular connecting means mounted on an end of the shielding conductor and contacting the shielding shell, the connecting means including a crimping ring fit on the end of the shielding conductor and crimped for fixing the tubular connecting means to the shielding conductor and for defining at least one rib extending substantially in a longitudinal direction;

a cover fixed to the housing to retain the connecting means; and locking means formed in the cover for engaging the rib and substantially preventing turn of the connecting means about an axis thereof by the mutual engagement.

2. The shielded connector of claim 1, wherein the shielding shell is integrated into the connector housing by insert molding.

3. The shielded connector of claim 1, wherein the connecting means includes a shell connecting member that is fittable to an end of the shielding conductor and can contact the shielding shell.

4. The shielded connector of claim 1, wherein the rib projects substantially radially out from the crimping ring and the locking means includes at least one recess formed in the cover to receive the rib.

5. The shielded connector of claim 4, wherein the at least one rib comprises a plurality of ribs and the at least one recess comprises a plurality of recesses, the ribs and the recesses are arranged at a plurality of circumferentially spaced positions and are selectively engageable with one another.

6. A shielded connector to be connected with a shielded cable having wires surrounded by a shielding conductor, comprising:

a housing with terminal-receiving cavities extending therethrough in a longitudinal direction;

a conductive shielding shell in the housings and substantially surrounding the terminal-receiving cavities;

a conductive shell connecting member mounted in an end of the shielding conductors and contacting the shielding shell;

a crimping ring crimped inwardly for urging the shielding conductors against the shell connecting member, the crimping ring having at least one rib projecting outwardly thereon and aligned substantially along the longitudinal direction; and a cover mounted over the crimping ring and having at least one recess extending in the longitudinal direction and engaging the rib to prevent rotation of the cover, the cover being fixed to the housing to hold the shell connecting member on the housing and in contact with the shielding shell.

7. The shielded connector of claim 6, wherein the at least one rib comprises two diametrically opposed ribs, and the at least one recess comprises a plurality of recesses disposed so that two of the recesses are engageable with the ribs.

8. The shielded connector of claim 7, wherein the housing (5) and the cover (17) are made of resin.

9. A method of connecting a shielded connector with a shielded cable formed by wrapping wires together by a shielding conductor, the method comprising:

connecting terminal fittings with ends of the respective wires;

providing a housing for accommodating the terminal fittings and having a shielding shell provided with the housing for substantially surrounding the terminal fittings;

mounting a tubular shell connecting member in an end of the shielding conductor on part of the shielding shell;

mounting a crimping ring on the end of the shielding connector;

crimping the crimping ring to secure the crimping ring and the shell connecting member to the shielding conductor, the crimping being carried out to form a plurality of ribs on the crimping ring;

providing a cover having engaging recesses formed therein;

fixing the cover to the housing so that the recesses engage the ribs of the crimping ring for substantially preventing a turn of the crimping ring about an axis thereof.

10. The method of claim 9, wherein the shielding shell is integrated into the connector housing preferably by insert molding.

* * * * *